US008458814B1

(12) United States Patent
Voto

(10) Patent No.: US 8,458,814 B1
(45) Date of Patent: Jun. 11, 2013

(54) COOKIE CUTTING GLOVE

(76) Inventor: Patricia Voto, Staten Island, NY (US)

( * ) Notice: Subject to any disclaimer, the term of this patent is extended or adjusted under 35 U.S.C. 154(b) by 264 days.

(21) Appl. No.: 13/017,109

(22) Filed: Jan. 31, 2011

Related U.S. Application Data

(60) Provisional application No. 61/338,387, filed on Feb. 18, 2010.

(51) Int. Cl.
*A41D 19/00* (2006.01)

(52) U.S. Cl.
USPC ..... 2/160; 2/161.6

(58) Field of Classification Search
USPC ..... 2/16, 20, 160, 158, 159, 161.6, 161.8; 30/301, 302, 316
See application file for complete search history.

(56) References Cited

U.S. PATENT DOCUMENTS

| | | | | | |
|---|---|---|---|---|---|
| 2,478,571 | A * | 8/1949 | Creider | 30/301 |
| 2,612,123 | A | 9/1952 | Nord | |
| 4,327,489 | A | 5/1982 | Conrad | |
| 4,836,396 | A | 6/1989 | Ancona et al. | |
| D357,614 | S | 4/1995 | Champane | |
| 5,499,914 | A * | 3/1996 | Rist | 425/470 |
| 5,853,210 | A * | 12/1998 | Robinson | 294/25 |
| 5,878,438 | A * | 3/1999 | Ragsdale | 2/158 |
| 5,878,439 | A * | 3/1999 | Waters, Jr. | 2/161.6 |
| 6,000,058 | A * | 12/1999 | Iselin | 2/160 |
| 6,374,417 | B1 * | 4/2002 | Stagnitta | 2/161.8 |
| 6,381,852 | B1 | 5/2002 | Wallays et al. | |
| 6,401,253 | B2 * | 6/2002 | Brunson | 2/160 |
| 7,331,776 | B2 | 2/2008 | Errera | |
| 7,624,456 | B2 * | 12/2009 | Williams et al. | 2/169 |
| 8,256,030 | B2 * | 9/2012 | Williams et al. | 2/169 |
| 8,281,416 | B1 * | 10/2012 | Smith | 2/161.6 |
| 2007/0124849 | A1 * | 6/2007 | Williams et al. | 2/275 |
| 2007/0220653 | A1 * | 9/2007 | Mack et al. | 2/159 |
| 2007/0234466 | A1 * | 10/2007 | Stengel | 2/160 |
| 2008/0092262 | A1 | 4/2008 | Carr | |
| 2008/0316868 | A1 | 12/2008 | Sardis | |
| 2009/0126074 | A1 * | 5/2009 | Mattesky | 2/161.8 |

* cited by examiner

*Primary Examiner* — Shelley Self
*Assistant Examiner* — Andrew Sutton
(74) *Attorney, Agent, or Firm* — Goldstein Law Offices, P.C.

(57) ABSTRACT

A cookie cutting glove having a cookie cutter or cookie stamp attached to a glove for use by children and adults to cut and shape cookie dough easily and enjoyably while requiring minimal small motor skills. The glove has an internal layer of a resilient polymer that provides a rigidity to the glove when a user presses the cookie cutter in the dough as well as provides insulation against heat and electricity. The cookie cutter is attached to the glove by many variations, such as a strap or a ribbon. The glove is not limited to one specific style, but is any style that covers a palm and a back of a hand and has a plurality of finger cavities. In one embodiment, an outer surface of the glove itself is the cookie cutter. Without the cookie cutter, the glove is useful as an oven mitt.

8 Claims, 4 Drawing Sheets

COOKIE CUTTING GLOVE

CROSS-REFERENCE TO RELATED APPLICATIONS

This application is a nonprovisional utility application of the provisional patent application, Ser. No. 61/338,387 filed in the United States Patent Office on Feb. 18, 2010 and claims the priority thereof.

BACKGROUND OF THE INVENTION

The invention relates generally to a cookie cutting glove. More particularly, the invention relates to a glove with an attached cookie cutter for use by children and adults to cut and shape cookie dough easily and enjoyably while requiring minimal small motor skills.

Small children love to help around the home and engage in grown-up activities. They love learning how to make things, especially in the kitchen. What is a chore for adults is a joyful activity for young children. Making something to eat, especially if it is delicious and sweet, is a favorite activity. The kitchen is the one place in the home where making small messes is allowed, even in the most fastidious of homes.

Baking cookies together is a most-loved activity of all generations. Many people have fond childhood memories of sharing special moments in the kitchen with a parent, grandparent, adult relative or friend learning to bake cookies. Often the cookies are shaped or decorated to celebrate an upcoming holiday such as Christmas, Halloween or Valentine's Day. Other times, the cookies have the shapes of a child's favorite animal, letters of the alphabet, or any of hundreds of other possible shapes. Sometimes the cookies have a design stamped into the surface, such as traditional springerli cookies. Using cookie cutters and stamps to cut dough into shapes and pictures is a fun activity that children like to imitate with modeling clay.

Kids love to use grown-up kitchen tools or miniature versions of the same. However, with small hands and limited small motor skills, kitchen tools may be difficult to manipulate. Cookie cutters traditionally come with very small handles or none at all. They are generally not easy to manipulate by young children or someone with arthritic hands. Cognizant of that, there are various designs for gripping handles that fit inside a fist rather than require fingertip manipulation. Others have created mounting devices such as storage lids, and container bottoms to engage the cookie cutter so that a young baker has something that does not require small motor skills to grasp.

Kids also sometimes hygienically challenged, touching their face, lips, and nose with their hands and then touching the food without washing their hands first. Ideally, a child, as well as adults, should wear gloves while handling food. Most disposable gloves come only in adult sizes. Oversized gloves make manipulating cookie cutters and kitchen tools even more difficult. Others have designed mitts specifically for young children that have additional gripping surfaces, but these bulky gloves are generally to be used only for handling hot objects.

While these units may be suitable for the particular purpose employed, or for general use, they would not be as suitable for the purposes of the present invention as disclosed hereafter.

SUMMARY OF THE INVENTION

It is an object of the invention to produce a cookie cutting glove that makes cutting cookie dough in shapes easy for a child or an adult with arthritis. Accordingly, a cookie cutting glove with an attached cookie cutter does not require fine motor skills to hold the cookie cutter, making cutting cookie dough easier and more enjoyable.

It is another object of the invention to produce a cookie cutting glove that cuts cookie dough hygienically. Accordingly, the cookie cutting glove covers a hand of a user when cutting cookie dough, keeping the hand of the user clean and keeping the cookie dough clean from inadequately washed hands.

It is a further object of the invention to produce a cookie cutting glove that is fun to use by children and adults. According, the cookie cutting glove has a fabric outer surface that may be decorated in patterns and designs that may be coordinated with or duplicated in child and adult sizes to delight the users.

It is yet another object of the invention to produce a cookie cutting glove that protects the user from heat. Accordingly, the cookie cutting glove has an internal layer that is a molded resilient plastic, providing heat insulation for using the cookie cutting glove as an oven mitt or pot holder when the cookie cutter is removed.

It is yet a further object of the invention to produce a cookie cutting glove that protects the palm of the user from a top edge of a cookie cutter. Accordingly, the cookie cutting glove has an internal layer that is a molded resilient plastic that provides a slightly rigid surface to press against the top edge of the cookie cutter, protecting the palm of the user.

The invention is a cookie cutting glove having a cookie cutter or cookie stamp attached to a glove for use by children and adults to cut and shape cookie dough easily and enjoyably while requiring minimal small motor skills. The glove has an internal layer of moldable resilient plastic resin that provides a rigidity to the glove when a user presses the cookie cutter in the dough as well as provides insulation against heat and electricity. The cookie cutter is attached to the glove by a variety of attaching means, such as a strap or a ribbon. The glove is not limited to one specific style, but is any style that covers a palm and a back of a hand and has a plurality of finger cavities. In one embodiment, an outer surface of the glove itself is the cookie cutter. Without the cookie cutter, the glove is useful as an oven mitt.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
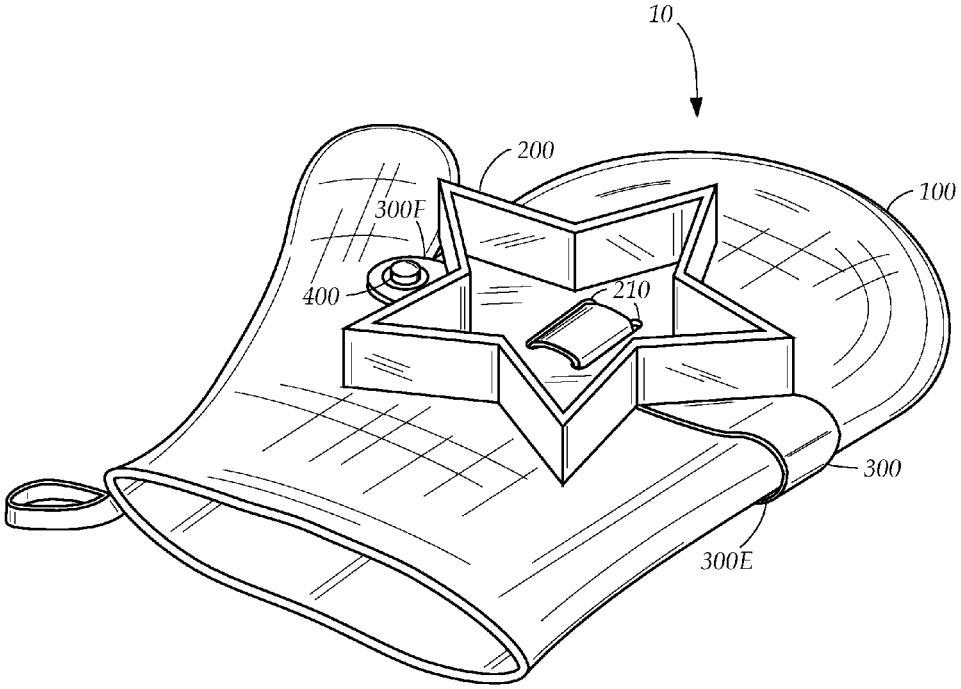
FIG. 1 is a diagrammatic perspective view of the invention from the bottom.

FIG. 1 illustrates a cookie cutting glove 10 in the shape of a mitten with a cookie cutter 200 attached to a glove 100. The cookie cutter 200, having a pair of openings 210, is attached to the glove 100 by a strap 300 that is inserted through the openings 210. The user, having a pair of hands, places the glove 100 with the cookie cutter 200 onto a hand and presses the cookie cutter 200 into cookie dough, cutting and forming the dough into a desired shape. The glove is assembled with a plurality of layers, having an internal layer of molded resilient plastic resin. The internal plastic resin layer provides a solid surface to press the cookie cutter 200 into the dough, but is also sufficiently flexible for the hand to flex the glove 100 in order to grasp objects. Cookie cutters 200 are available in a plurality of shapes. When the user desires a different shape, the user removes the cookie cutter 200, having a first shape, from the strap and attaches a cookie cutter having a second shape.

Figure 2:
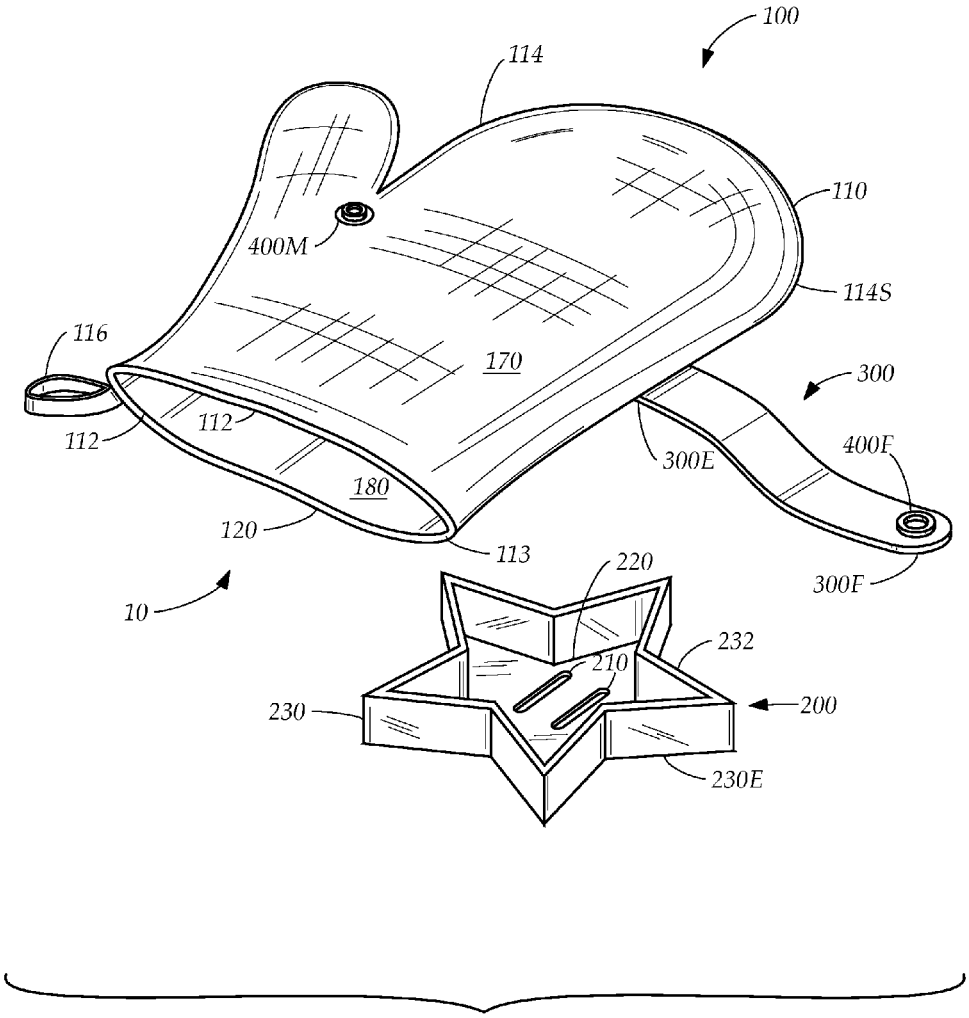
FIG. 2 is an exploded perspective view of the invention from the bottom.

FIG. 2 illustrates each element of the invention separately in an exploded view. While the drawing shows the glove 100 in the shape of a mitten, it is understood that the invention is not limited to any specific style of glove. For this discussion, the glove is a covering worn on the hand, the hand having a palm with a back and a plurality of fingers including a thumb attached to the palm, the glove covering the palm and the back of the hand and having a plurality of cavities for inserting the fingers and palm; the cavities being either enclosed by material or open. It should also be understood that while the drawing illustrates the glove in a left-handed configuration, the invention is not limited to a particular handedness, and that a right-handed configuration is merely a mirror image of the illustrated left-handed configuration.

In the illustrated example, the glove has a top piece 120 and a bottom piece 110, each with a bottom edge 112, and a contour edge 114, outlining the contour of the palm and finger cavities. Both the top piece 120 and bottom piece 110 have at least two layers, the layers including an inside layer 180, and an outside layer 170.

Figure 3:
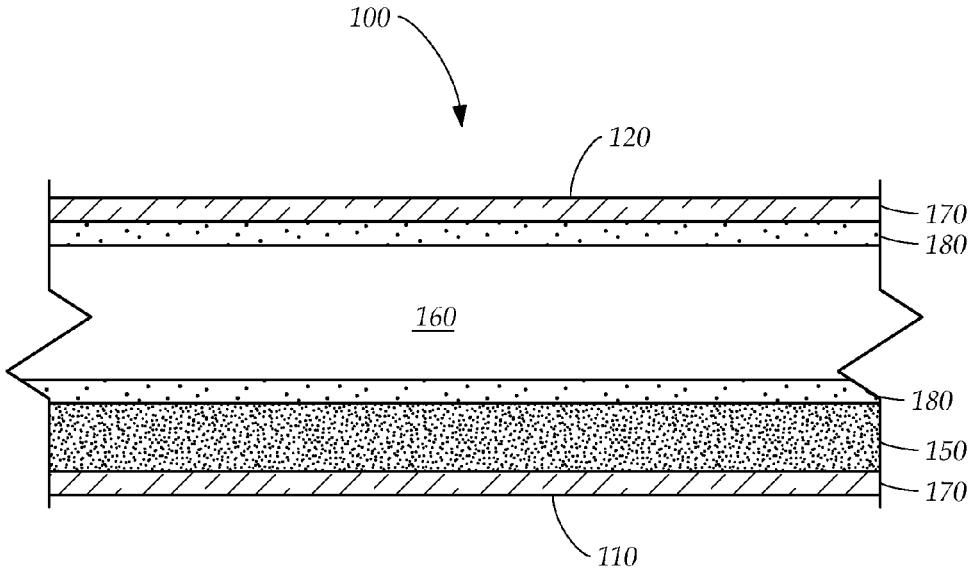
FIG. 3 is a cross-sectional view of the glove, showing the assembled layers.

FIG. 3 shows the assembled plurality of layers of the glove 100 in a cross-sectional view. Between the outer layer 170 and the inner layer 180, the bottom piece 110 has an internal layer 150 of molded resilient plastic resin, such as, for example, but not limited to, acrylonitrile butadiene styrene polymer, known also under the trade name Neoprene, silicone, or para-aramid polymer, known also as KEVLAR® (KEVLAR® is the registered trademark of E. I. duPont de Nemours and Company, Wilmington, Del.) The internal layer 150 provides a solid surface for the necessary rigidity to press the cookie cutter into the dough, but is also sufficiently flexible for the hand to flex the glove in order to grasp objects. In one embodiment, both the top piece 120 and the bottom piece 110 have the internal layer so that glove can be reversed and worn on either hand ambidexterously. The internal layer 150 also provides insulation from heat and electricity as well as protects the hand from the top edge of the cookie cutter wall. The cookie cutter is selectively removed from the glove 100 and the glove is used as an oven mitt or a potholder.

The outer layer 170 is a fabric such as, for example, cotton or cotton-polymer blend. The outer layer 170 may be dyed or colored in different patterns or painted with different designs to delight both the child and adult user. The designs and patterns on the outer layer 170 of a child's glove may coordinate with or duplicate the designs and patterns on the outer layer 170 of an adult's glove to increase the enjoyment of the users. The inner layer 180 is a fabric, such as, for example, cotton or cotton-polymer blend and may optionally include cotton batting to provide additional insulation and protect the hand. Between the inner layer of the top and the inner layer of the bottom is the cavity 160 for the hand.

Referring to FIG. 2, the top piece 120 and the bottom piece 110 are joined at the contour edges 114 to form a seam 114S with the bottom edges free 112 and separate to form an open cavity 160 to insert the hand. The glove optionally has a loop 116 attached to the bottom edge 112. The bottom edge 112 is bound or hemmed and optionally trimmed with a cloth tape 113 such as, for example, but limited to, bias tape, binding tape, piping or ribbon to add interesting details to appeal to the user. The strap 300 has a pair of ends, a first end 300E fixed to the glove 100 and a second end 300F with a snap 400. The second end 300F of the strap 300 is threaded through the openings 210 in the cookie cutter 200 and then snapped in place to the glove 100. The snap 400 on the glove 100 has a pair of interlocking discs, a first disc fixed to the glove 100 and a second disc on the second end of the strap 300F. In the illustration, a male disc 400M of the snap is shown on the glove 100 and a female disc 400F on the strap 300, as a non-limiting example; the gender of the interlocking discs is inconsequential and the discs can be interchanged. The second end 300F of the strap can be affixed to the glove 100 by many variations such as, for example, but not limited to snaps, buttons, or hook and loop fastener material. It is understood that numerous variations in attaching the second end 300F of the strap 300 to the glove are possible, while adhering to the inventive concept.

The cookie cutter 200 has a top planar surface 220 and a closed peripheral wall 230 having a bottom cutting edge 232 and a top edge 230E attached at a right angle to the top planar surface 220. The closed peripheral wall 230 forms the desired shape that will be produced when the cutting edge 232 is applied to cookie dough. Optionally, additional closed walls with the cutting edge and the top edge attached at a right angle to the top planar surface 220 may be placed inside the closed peripheral wall to create additional features in the cookie dough. For example, additional closed walls may cut out eyes and other features in a jack-o-lantern cookie. The cookie cutter 200 has the pair of openings 210 in the top planar surface 220 to insert the strap 300. Additionally, the openings 210 prevent an air lock from forming when the dough is cut, making it easier to release the dough from the cutting edge 232. The cookie cutter 200 may be made from, for example, but not limited to, molded plastic resin, copper, stainless steel or other suitable materials that are well known to those of ordinary skill in the art and are beyond the scope of this discussion. In the drawing, the cookie cutter 200 is in the shape of a star, as a non-limiting example. It is understood that cookie cutters are produced in hundreds of shapes, and that regardless of the shape of the peripheral closed walls 230 of the cookie cutter, the principals of the invention still hold as discussed hereinabove.

To assemble the invention, as shown in FIG. 1, the second end of the strap 300F is inserted through the pair of openings 210 in the top planar surface of the cookie cutter 200 and then snapped in place to the outer surface 170 of the glove 100 by interlocking the disks of the snap 400. In one embodiment, the cookie cutter 200 is attached to the bottom piece 110 of the glove 100. In another embodiment, the cookie cutter is attached to the top piece 120 of the glove 100. In another embodiment, the cookie cutter is attached to the top piece 120 when the glove 100 is on a first hand of a pair of hands and reversed by placing the glove 100 on a second hand of the pair of hands. When the user changes the glove from one hand to the other placing the cookie cutter on the back of the hand, the resilient internal layer is now in the layers of the top piece 120. It is understood that the strap 300 presents one method of attaching the cookie cutter 200 to the glove 100 and that the cookie cutter 200 can be attached to the glove 100 by other methods while adhering to the inventive concept. For example, the cookie cutter 200 may be tied with a ribbon, held by a flap, held by a zippered flap, or snapped directly onto the glove. In another embodiment, a stainless steel cookie cutter can be attached magnetically to the glove.

In another embodiment, a plurality of cookie cutters is attached to a plurality of fingers on the glove. For example, the cookie cutters are attached to a plurality of fingers on the bottom surface of the glove, to a plurality of knuckles on the top surface of the glove, or to a plurality of finger tips on the glove. These are non-limiting examples and many other variations in attaching the cookie cutters to fingers on the glove are possible within the inventive concept.

In yet another embodiment, the outer surface of the glove is covered with a molded resilient plastic material, molded into different shapes, each with a closed peripheral wall having a cutting edge. In this embodiment, the entire outer surface of the glove is used as a cookie cutter. Optionally, the entire outer surface of the glove is covered with an intaglio surface or a relief surface to imprint the cookie dough with an image or design.

In another embodiment, a cookie stamp imprints a design and outlines the shape of the cookie in the dough. The cookie stamp has an intaglio or relief surface that creates a design when pressed into cookie dough using the same processes as cutting the dough with a cookie cutter. The cookie stamp attaches to the glove in the manner suitable to attach the cookie cutter as described hereinabove.

It is understood that the glove can be, for example, a mitten with two finger cavities, a first for the thumb and a second for the fingers, as illustrated, but also a mitten with three finger cavities, a glove with closed openings for each finger, a fingerless glove with a plurality of open cavities in place of closed cavities or a glove that has both open and closed finger cavities. In one embodiment, the glove covers a palm and a back of the hand, with the fingers free in one open cavity. It is understood that numerous variations in the configuration of the glove are possible, while adhering to the inventive concept. The glove may be fabricated in a variety of sizes to fit various sizes of adult and children hands.

Figure 4:
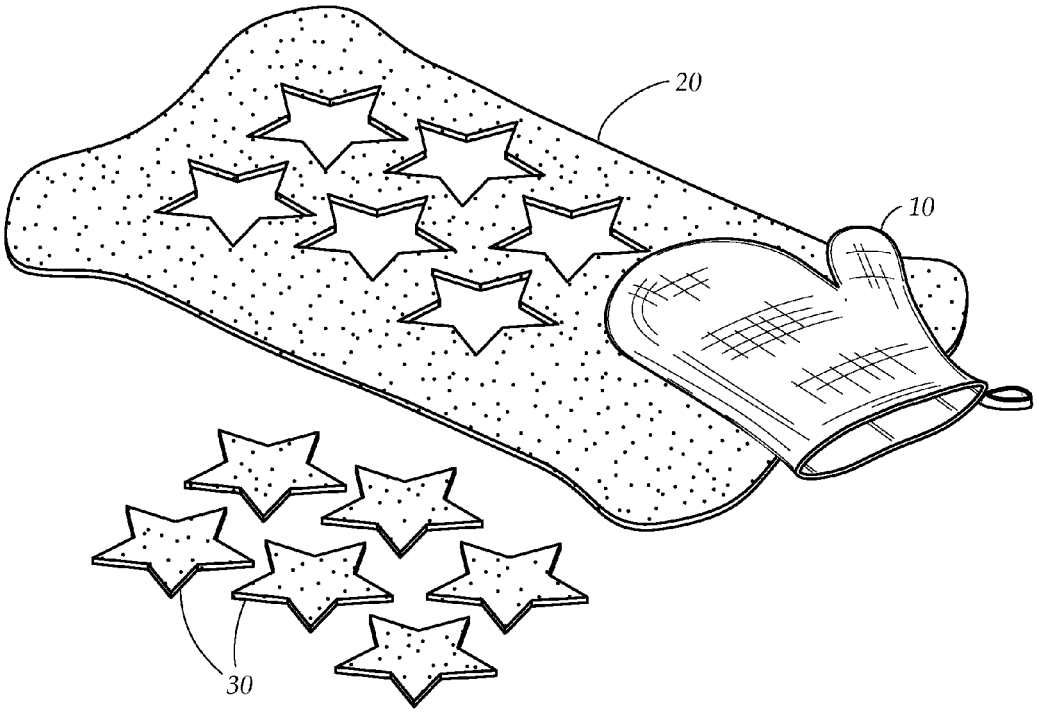
FIG. 4 is a diagrammatic perspective view from the top of the invention, demonstrating the invention cutting cookie dough.

FIG. 4 shows how to use the cookie cutting glove 10. The user selects a cookie cutter of a desired shape. The user attaches the cookie cutter to the bottom surface of the glove 100 by the placing the strap through the openings in the cookie cutter and snapping the end of the strap to the glove by other methods discussed hereinabove. The user places the cookie cutting glove 10 on his or her hand, with the cookie cutter under the palm of the hand. The user rolls out the cookie dough into a flat sheet. The user presses the cookie cutter into the dough 20 with the palm of the hand inside the glove. The cutting edge of the cookie cutter cuts the dough. The user picks up the cut dough 30 with the cookie cutter or with another tool and places it separately on a flat surface for decorating or baking later. The cookie cutting glove 10 keeps the user's hand clean from the dough and the dough clean from improperly washed user's hand. In one embodiment, the user places the glove on the opposite hand and presses the back of the hand with the cookie cutter into the dough, giving the user a fun variation in method.

When the user wishes to create cookies with other shapes, the user detaches the first cookie cutter by unsnapping the strap and removing the first cookie cutter and placing the strap through the openings of the second cookie cutter and reattaching the strap to the glove. When the user wishes to use the glove as an oven mitten, the user removes the cookie cutter as described hereinabove and uses the glove to grasp any hot objects.

In conclusion, herein is presented a glove with an attached cookie cutter for use by children and adults to cut and shape cookie dough easily and enjoyably while requiring minimal small motor skills. The invention is illustrated by example in the drawing figures, and throughout the written description. It should be understood that numerous variations are possible, while adhering to the inventive concept. Such variations are contemplated as being a part of the present invention.

What is claimed is:

1. A cookie cutting glove for cutting and shaping cookie dough, worn on a user's hand, the hand having a palm with a back, a plurality of attached fingers including a thumb, comprising:

a cookie cutter, the cookie cutter having a top planar surface, the cookie cutter also having a closed peripheral wall with a bottom cutting edge attached to the top planar surface, the cutting edge for cutting the cookie dough;

a glove, the glove having a bottom side with a contour edge and a bottom edge, the bottom side covering the palm of the hand, a top side with a contour edge and a bottom edge, the top side covering the back of the hand, the bottom side and top side selectively joined at the contour edges, the edges forming a plurality of cavities for inserting the fingers and the bottom edges forming an opening for the palm, the glove having a plurality of layers with an internal layer of resilient polymer between the layers on the bottom side of the glove, the internal layer providing a solid surface to press the cookie cutter into the dough; and a pair of openings on the top planar surface of the cookie cutter, the glove having a snap disc on the bottom side, the glove also having a strap, the strap having a pair of ends, a first end attached to the glove and a second end having a snap disc matched to the snap disc on the glove, the second end inserted into the openings on the cookie cutter and the pair of snap discs snapped together, attaching the strap with the cookie cutter to the glove.

2. A cookie cutting glove for cutting and shaping cookie dough, worn on a user's hand, the hand having a palm with a back, a plurality of attached fingers including a thumb, comprising:

a cookie cutter, the cookie cutter having a top planar surface, the cookie cutter also having a closed peripheral wall with a bottom cutting edge attached to the top planar surface, the cutting edge for cutting the cookie dough;

a glove, the glove having a bottom side with a contour edge, a bottom edge and a snap disc, the bottom side covering the palm of the hand, a top side with a contour edge and a bottom edge, the top side covering the back of the hand, the bottom side and top side selectively joined at the contour edges, the edges forming a plurality of cavities for inserting the fingers and the bottom edges forming an opening for the palm, the glove having a plurality of layers, with an internal layer of resilient polymer between the layers on the bottom side of the glove, providing a solid surface to press the cookie cutter into the dough; and a strap, the strap having a pair of ends, a first end attached to the glove and a second end having a snap disc matched to the snap disc on the glove, the second end inserted into the openings on the cookie cutter, the pair of snap discs snapping together, attaching the strap with the cookie cutter to the glove.

3. The cookie cutting glove as described in claim 2, wherein the glove is mitten-shaped, having a first cavity for the palm and fingers and a second cavity for the thumb.

4. The cookie cutting glove as described in claim 2, wherein the glove has an internal resilient polymer layer between the fabric layers of the glove top, allowing the glove to be used ambidextrously.

5. The cookie cutting glove as described in claim 2, wherein the resilient polymer layer is composed of a plastic resin selected from the group consisting of acrylonitrile butadiene styrene polymer, silicone and para-aramid polymer.

6. A method of using a cookie cutting glove for cutting and shaping cookie dough, the cookie cutting glove having a cookie cutter, a glove having a bottom, and a means for attaching the cookie cutter to the bottom of the glove, comprising:

rolling out cookie dough on a flat surface, forming a thin layer of dough;

placing the glove on the hand with the cookie cutter attached to the bottom of the glove;

cutting the cookie dough by pressing the bottom of the cookie cutting glove into the dough with the internal plastic resin layer providing the necessary rigidity; and placing the cut cookie dough on a flat surface for further preparation.

7. The method of using a cookie cutting glove as described in claim 6, wherein the step of placing the cut cookie dough on a flat surface for further preparation is followed by the step of detaching the cookie cutter from the glove and using the glove as a pot holder, the plastic resin layer protecting a user from the heat.

8. The method of using a cookie cutting glove as described in claim 6, wherein the step of placing the cut cookie dough on a flat surface for further preparation is followed by the step of detaching a first cookie cutter from the glove and attaching a second cookie cutter to the glove and repeating the steps of:

cutting the cookie dough by pressing the bottom of the cookie cutting glove into the dough with the internal plastic resin layer providing the necessary rigidity; and placing the cut cookie dough on a flat surface for further preparation.

* * * * *